United States Patent [19]

Cochran

[11] Patent Number: 4,519,456

[45] Date of Patent: May 28, 1985

[54] CONTINUOUS FLOW PERFORATION WASHING TOOL AND METHOD

[75] Inventor: Chudleigh B. Cochran, Houston, Tex.

[73] Assignee: Hughes Tool Company, Houston, Tex.

[21] Appl. No.: 640,535

[22] Filed: Aug. 13, 1984

Related U.S. Application Data

[63] Continuation of Ser. No. 448,881, Dec. 10, 1982, abandoned.

[51] Int. Cl.[3] ..... E21B 37/00; E21B 33/124

[52] U.S. Cl. ..... 166/312; 166/147; 166/187

[58] Field of Search ..... 166/312, 311, 147, 146, 166/185, 186, 187, 127, 151, 191, 122, 183

[56] References Cited

U.S. PATENT DOCUMENTS

| | | | |
|---|---|---|---|
| 2,164,195 | 6/1939 | Waltermire | 166/187 |
| 2,378,469 | 6/1945 | Denton | 166/122 |
| 2,715,943 | 8/1955 | True | 166/187 |
| 2,762,441 | 9/1956 | Newlin | 166/186 |
| 3,062,291 | 11/1962 | Brown | 166/120 |
| 3,265,132 | 8/1966 | Edwards, Jr. | 166/120 |
| 3,381,749 | 5/1968 | Chenoweth | 166/147 |

FOREIGN PATENT DOCUMENTS

| | | | |
|---|---|---|---|
| 1301406 | 7/1962 | France | 166/187 |

*Primary Examiner*—James A. Leppink
*Assistant Examiner*—Hoang C. Dang
*Attorney, Agent, or Firm*—Robert A. Felsman; Charles D. Gunter, Jr.

[57] ABSTRACT

A continuous flow well bore perforation washing tool is shown of the type having a tubular mandrel with sidewalls defining a flow passage, an upper end for connection in a pipe string and a lower end with means for blocking the flow of fluid from the pipe string through the mandrel. Upper and lower pressure responsive packer assemblies are carried on opposite ends of the mandrel. An outer setting sleeve surrounds the mandrel between the packer assemblies to define an annular chamber between the mandrel and setting sleeve. A continuous flow passage communicates the mandrel interior, the annular chamber, and the well bore. Selectively sized orifices in the setting sleeve form a restriction in a portion of the continuous flow passage. By selectively sizing the orifices, a back pressure buildup can be created in the annular chamber which is used to set the packer assemblies as fluid is continuously flowed through the continuous flow passage.

8 Claims, 2 Drawing Figures

CONTINUOUS FLOW PERFORATION WASHING TOOL AND METHOD

This application is a continuation of application Ser. No. 448,881, filed 12/10/82, now abandoned.

BACKGROUND OF THE INVENTION

The present invention relates generally to well bore equipment used in completion and workover of oil well and/or gas wells. Specifically, the invention relates to a continuous flow well washing tool and method for circulating fluids through well conduits and into surrounding formations for formation treatment.

Oil and gas wells are completed by installing a production casing into the hole from the surface and cementing the casing in place. After the production casing is installed, the casing is perforated at the producing depth and the oil and/or gas flows from the surrounding earthern formation through the casing perforations and up the production casing to the surface, usually through production tubing.

It is often necessary to treat the earthern formation which surrounds the perforated casing to enhance the flow of produced fluids. The treatment technique employed generally involves circulating water or an acid solution through the casing perforations, into the formation, and back up the casing string. Such washing of the formation allows loose sand to be flushed from the formation or consolidated, the creation of voids for improved gravel packing, and other techniques whereby fluid flow is improved in tight formations.

Various well washing tools are known in the art for packing of an area of the casing to allow fluid circulation. Such tools are usually lowered into the well bore on a tubing string at which point packers seal off the casing above and below the formation perforations, after which circulation of treating fluid is commenced. The treating fluid is usually circulated down the string supporting the wash tool, through the tool and out between the packers, and out the casing perforations into the formation. Flow then continues back into the casing through perforations above the packers allowing the returning fluid to flow upwardly through the casing above the wash tool.

Certain of the prior art wash tools were of the cup type packer arrangement. Cup type packers have been known to fail to adequately seal under conditions encountered in the well bore. Also, since the cup type packers engage the casing while the tool is being run into the well or pulled out of the well, they are sometimes torn or damaged during use.

One prior art wash tool included a tubular mandrel with packer assemblies carried on the mandrel at opposite ends thereof and an outer tubular body surrounding the mandrel between the packer assemblies. An annular chamber provided between the mandrel and the surrounding tubular body was in fluid comunication with the mandrel interior through ports in the walls of the mandrel. The tubular body was provided with ports which permitted fluid communication between the annular chamber and the exterior of the tool when a valve assembly carried in the annular chamber was actuated in response to a predetermined pressure increase. The packer assemblies were first set and then the valve assembly was actuated to provide fluid communication necessary for circulating fluids through the tool for washing the surrounding formation. The valving arrangement was not always reliable due to the presence of sand and other contaminants in the fluid being circulated through the valve.

SUMMARY OF THE INVENTION

The continuous flow perforation washing tool of the invention has a tubular mandrel having exterior sidewalls and an interior flow passage, an upper end adapted to be connected in a pipe string extending to the well surface, and a lower end with means adapted to block the flow of fluid from the pipe string through the mandrel flow passage. Upper and lower packer assemblies are carried on the mandrel at opposite ends thereof, each of the packer assemblies including an elastomeric seal ring.

An outer setting sleeve surrounds the mandrel between the packer assemblies and defines an annular chamber between the mandrel and the setting sleeve. The annular chamber is in continuous fluid communication with the mandrel flow passage through port means provided in the sidewalls of the mandrel.

The outer setting sleeve is connected to a first seal body at one end thereof which is slidably received on the mandrel exterior. Preferably the seal body has an outer recess for receiving one of the elastomeric seal rings and includes a face region abutting an end of the seal ring and a sleeve portion which contacts the interior of the seal ring. A second seal body has an annular seal portion slidably received between the mandrel exterior and the end of the setting sleeve opposite the first seal body. The second seal body preferably has an outer recess for receiving the other of the elastomeric seal rings and includes a face region abutting an end of the second seal ring and a sleeve portion which contacts the interior of the second seal ring.

A plurality of selectively sized orifices communicate the annular chamber with the well bore to provide controlled flow of fluid to the well bore whereby fluid pressure communicated by the port means in the mandrel to the annular chamber acts on the first and second seal bodies to seal the elastomeric seal rings in the well bore.

The selectively sized orifices form a restriction in a portion of the continuous flow passage through the tool, mandrel ports, annular chamber, and orifices. The restriction causes a back pressure buildup in the annular chamber which sets the packer assemblies as fluid is continuously flowed through the continuous flow passage.

In the method for circulating fluid in a well having a perforated casing, a wash tool is attached to the lower end of a pipe string. The wash tool has an inner mandrel with a flow passage therethrough communicating with the pipe string. Pressure responsive packer assemblies are provided at opposite ends of the mandrel and a setting sleeve surrounds the mandrel between the packer assemblies to define an annular chamber. Ports communicate the mandrel interior with the annular chamber and selectively sized orifices communicate the annular chamber with the well bore.

The wash tool is lowered on the pipe string to the desired circulation level within the perforated casing. Closure means are then actuated to close the lower end of the mandrel flow passage. Fluid is then pumped through the pipe string to the closed mandrel flow passage, through the ports in the mandrel to the annular chamber, and continuously through the sized orifices in the setting sleeve to the well bore. The number and size of the orifices are selected to provide a controlled flow of fluid through the orifices to create a back pressure in the annular chamber and thereby hydraulically actuate the packer assemblies.

The circulation of fluid is continued from the surface through the pipe string, mandrel, annular chamber and orifices, and through the perforations in the casing between the packer assemblies into the zone surrounding the casing. The fluid is circulated from the formation through perforations in the casing above the packer assemblies and back to the surface of the well through the annulus between the pipe string and the casing.

Additional features, objects, and advantages will be apparent in the written description which follows.

DETAILED DESCRIPTION OF THE INVENTION

Figure 1:
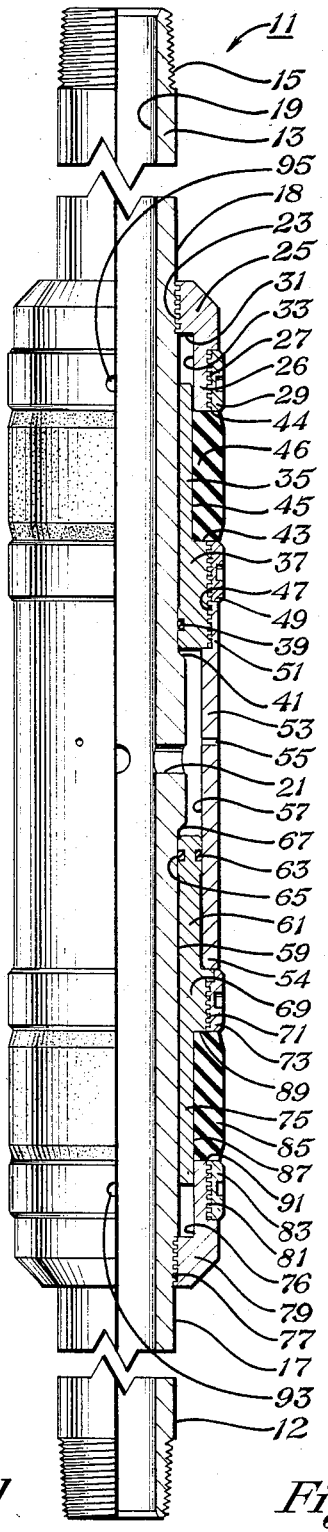
FIG. 1 is a side partial cross-sectional view of the wash tool of the invention showing the packer assemblies in the relaxed state.
Figure 2:
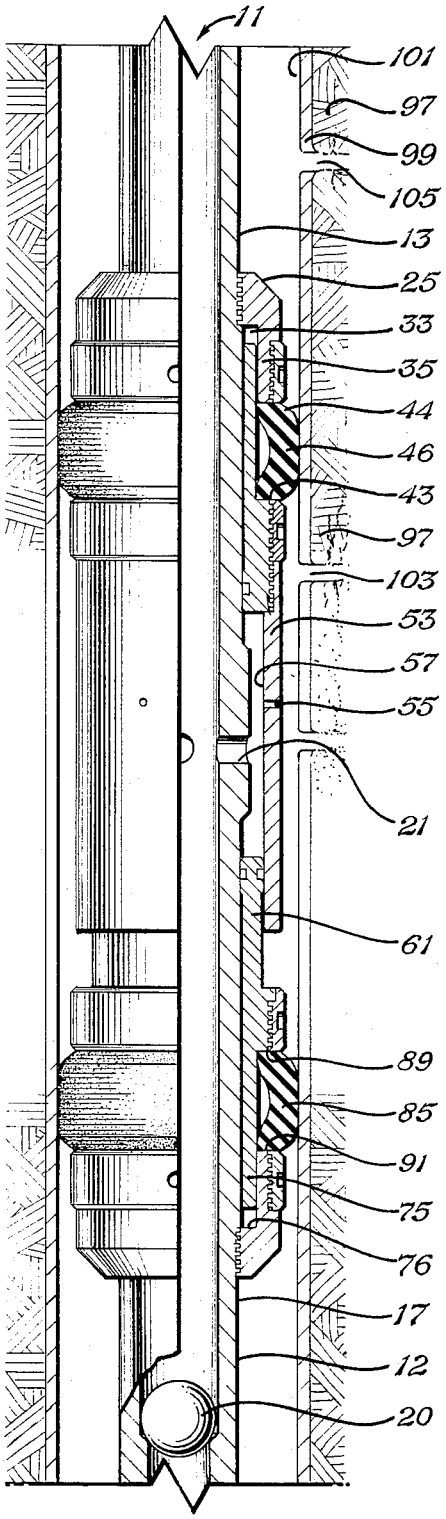
FIG. 2 is a side partial cross-sectional view of the wash tool of the invention similar to FIG. 1 showing the packers in the set position in a well bore.

Turning to FIG. 1, there is shown a continuous flow perforation washing tool of the invention designated generally as 11. The washing tool 11 includes a mandrel 13 having an upper externally threaded end 15 adapted to be connected in a pipe string (not shown) extending to the well surface, and a lower externally threaded end 17. Mandrel 13 has exterior sidewalls 18 and an internal bore 19 which communicates with the pipe string running to the surface when the wash tool 11 is made up in the pipe string. The lower end 17 of the wash tool 11 is connected to a bottom sub 12 with means adapted to block the flow of fluid from the pipe string through the mandrel flow passage at the lower end 17. Such means can comprise, for example, a ball catching sub adapted to receive a ball (20 in FIG. 2) dropped through the pipe string and through the internal bore 19 of the wash tool which seats in the catcher sub in the known manner to block off the flow of fluid.

As shown in FIG. 1, a port means comprising at least one opening 21 is provided in the mandrel in the approximate mid region thereof. The mandrel exterior also has a threaded surface 23 for threadedly engaging an upper header ring 25. Header ring 25 has a threaded exterior surface 27 for receiving a gage ring 29 on the exterior thereof. The internal diameter of the upper header ring 25 increases from the upper end thereof forming a clearance 33 between the header ring and mandrel exterior 18 and defining a shoulder 31 in the ring interior. An upper sleeve portion 35 of an upper seal body 37 is slidably received within the clearance 33 of the upper header ring 25. The upper seal body 37 is of a greater diameter than upper sleeve portion 35 and forms a fluid seal with the mandrel exterior 18 by means of an O-ring 39. A shoulder 41 formed in the mandrel exterior 18 provides a lower stop for the seal body 37. The external surface of seal body 37 has threads 47 for threadedly engaging a gage ring 49 similar to ring 29. The smaller relative diameter of upper sleeve portion 35 of upper seal body 37 forms a recess 45 in seal body 37 for receiving an elastomeric seal ring 46. The recess 45 in upper seal body 37 includes a face region 43 formed by seal body 37 and gage ring 49 which abuts the lower end of the elastomeric seal 46. The lower end 26 of upper header ring 25 and gage ring 29 together comprise a second face region 44 for abutting the upper end of the elastomeric seal 46. Upper sleeve portion 35 of seal body 37 contacts the interior of the seal ring 46. Elastomeric seal ring 46, upper header ring 25 and seal body 37 comprises an upper packer assembly.

A setting sleeve 53 surrounds the mandrel 13 between the upper packer assembly and a lower packer assembly which will be presently described and includes an upper portion 51 which is internally threaded to matingly engage the externally threaded surface 47 of upper seal body 37. Outer setting sleeve 53 is supported between the packer assemblies to define an annular pressure chamber 57. As seen in FIG. 1, chamber 57 is in continuous fluid communication with the mandrel flow passage 19 through port means 21 provided in the sidewalls of the mandrel. The setting sleeve 53 is provided with at least one sized orifice 55 which communicates the annular chamber 57 with the surrounding well bore.

The mandrel interior flow passage 19, ports 21 in the mandrel sidewalls, annular pressure chamber 57, and selectively sized orifices 55 together comprise a continuous flow passage from the pipe string through the tool to the well bore.

A lower seal body 69 is slidably received on the lower mandrel exterior 59 and sealingly engages the mandrel exterior by means of an O-ring 65. An annular seal portion 61 of lower seal body 69 is received between the mandrel exterior 59 and the lower end 54 of setting sleeve 53 and sealingly engages the setting sleeve 53 by means of an O-ring 63. A shoulder 67 formed in the mandrel exterior provides a stop at one end of the path of travel for annular seal portion 61. Lower seal body 69 has an externally threaded surface 71 adapted to receive a gage ring 73 similar to rings 29 and 49. Lower seal body 69 also includes a lower sleeve portion 75 carried on the mandrel exterior which together with seal body 69 and gage ring 73 forms a recess 87 for receiving a second elastomeric seal ring 85. The lower end of the mandrel 13 is provided with external threads 77 adapted to threadedly engage a lower header ring 79 similar to ring 25. Header ring 79 has a region of greater internal diameter which forms a clearance 76 with respect to the mandrel exterior 18 for slidably receiving the lower sleeve portion 75 of lower seal body 69. Lower header ring 79 has a threaded exterior surface 81 adapted to receive a gage ring 83. Lower seal body 69 and gage ring 73 form a face region 89 which abuts the upper end of elastomeric seal 85. The opposite end of elastomeric seal 85 abuts a similar face region 91 formed by lower header rings 79 and gage ring 83. Clearances 33 and 76 are vented to the well bore as by opening 93, 95. Lower header ring 79 has a threaded exterior surface 81 adapted to receive a gage ring 83.

The operation of the perforation wash tool of the invention will now be described in greater detail. The wash tool is first attached to the lower end of a pipe string and lowered on the pipe string to the desired circulation level within the perforated casing. In the running-in condition, the elastomeric seal rings 46, 85 are in the relaxed condition shown in FIG. 1. Once the tool has been run to the selected depth, the closure means are actuated to close the lower end of the mandrel flow passage, as by dropping a ball 20 to a ball catching sub (see FIG. 2) located below the lower end 17 of the tool 11. Fluid is then pumped through the pipe string from the surface to the closed mandrel flow passage 19 and through the port means 21 in the mandrel to the annular chamber 57. Fluid flows continuously through the selectively sized orifices 55 in the setting sleeve 53 to the surrounding well bore 101.

The number and sizes of the orifices 55 are selected to provide a controlled flow of fluid through the orifices 55 to create a back pressure in the annular chamber 57 to thereby hydraulically actuate the pressure responsive packer assemblies. Back pressure in chamber 57 causes upper and lower seal bodies 37, 69 to move in opposite directions in the manner of fluid pistons thereby causing the elastomeric seals 46, 85 to be compressed outwardly between the face regions 43, 44 and 89, 91, respectively. As long as fluid pressure is provided through the pipe string to the tool, the packer assemblies will remain in the sealed condition shown in FIG. 2. The selectively sized orifices 55 comprise restriction means in a portion of the continuous flow passage of the tool which cause a back pressure buildup in the annular chamber 57 to set the packer assemblies as fluid continuously flows through the continuous flow passage.

The circulation of fluid is continued from the surface through the pipe string, mandrel 13, annular chamber 57, and orifices 55, through the perforations 103 in the casing between the packer assemblies and through the zone 97 surrounding the casing 99. Circulation is continued through the perforations 105 in the casing above the packer assemblies and back to the surface of the well through the annulus 101 between the pipe string and the casing 99.

The amount of pressure buildup inside chamber 57 is determined by the size and number of ports 21 in mandrel 13 and orifices 55 in setting sleeve 53. Thus, the diameters of the orifices 55 provided in sleeve 53 can be selectively smaller than the diameters of the ports 21 in the mandrel 13 by a predetermined amount, the ratios of the diameters being selected to control the buildup of back pressure in the annular chamber. Alternatively, the number of orifices 55 provided in the setting sleeve 53 can be greater than the number of ports in the inner mandrel by a predetermined amount, the ratio of the number of orifices 55 to ports 21 being selected to control the buildup of back pressure in the annular chamber 57.

The following examples are exemplary of the invention for a wash tool having a mandrel with $4\frac{7}{8}$ inch diameter ports therein:

| Casing Size | No. of Orifices | Diameter of Orifices |
|---|---|---|
| $3\frac{1}{2}$ | 4 | 3/32 |
| 5 | 6 | $\frac{1}{8}$ |
| $5\frac{1}{2}$ | 6 | 3/32 |
| 7 | 6 | $\frac{1}{8}$ |
| $7\frac{5}{8}$ | 4 | $\frac{1}{8}$ |
| $9\frac{5}{8}$ | 4 | $\frac{1}{8}$ |

As a typical example, a tool designed for a 7 inch casing is generally run on a $2\frac{1}{2}$ inch tubing pipe string to the desired location in the well bore. The packer assemblies can be set at the desired location by providing approximately 500–750 psi pressure from the surface to provide approximately four barrels per minute of treating fluid to wash the perforation.

Once the treatment is complete, the pressure of fluid being pumped through the pipe stream can be lowered to unseat the packer assemblies and the tool can be retrieved from the well bore or moved to a different location therein.

An invention has been provided with significant advantages. The continuous flow perforation wash tool of the invention can be set at the desired well bore location by merely increasing pump pressure of fluid being pumped through the pipe stream from the surface. The absence of valving within the annular chamber simplifies the design and improves reliability. Because there are no movable valve elements within the annular chamber, the presence of sand or other contaminants in the fluid being pumped does not pose a problem. The design of the upper and lower seal bodies provides greater surface area contact with the elastomeric seals and provides a mechanical advantage in compressing the seal members during the sealing operation.

While the invention has been shown in only one of its forms, it is not thus limited but is susceptible to various changes and modifications without departing from the spirit thereof.

I claim:

1. In a well bore perforation wash tool of the type having a tubular mandrel with sidewalls defining a flow passage, an upper end for connection in a pipe string and a lower end with means for blocking the flow of fluid from the pipe string through the mandrel, upper and lower pressure responsive, solid, compressible packer assemblies carried on opposite ends of the mandrel, and an outer setting sleeve surrounding the mandrel between the packer assemblies to define an annular chamber between the mandrel and setting sleeve, the improvement comprising:

a continuous flow passage communicating said mandrel interior, said annular chamber and said well bore prior to and after setting said packer assemblies, said continuous flow passage comprising port means in said mandrel sidewalls communicating said mandrel flow passage and said annular chamber and orifice means in said outer setting sleeve for communicating said annular chamber and said well bore; and wherein said port means and said orifice means are selectively sized to cause a predetermined back pressure buildup in said annular chamber to set said packer assemblies as fluid is continuously flowed through said continuous flow passage.

2. The well bore perforation wash tool of claim 1, wherein said predetermined back pressure buildup is determined by the size and number of said orifice means in said setting sleeve relative to said port means in said mandrel.

3. A continuous flow perforation washing tool for use in a well bore comprising:

a tubular mandrel having exterior sidewalls and an interior flow passage, an upper end adapted to be connected in a pipe string extending to the well surface, and a lower end with means adapted to block the flow of fluids from said pipe string through said mandrel flow passage;

upper and lower packer assemblies carried on said mandrel at opposite ends thereof, each of said packer assemblies including a solid, compressible elastomeric seal ring;

an outer setting sleeve surrounding said mandrel between said packer assemblies defining an annular chamber between said mandrel and said setting sleeve, said annular chamber being in continuous fluid communication with said mandrel flow passage through port means provided in the sidewalls of said mandrel and with said well bore through orifice means provided in said setting sleeve, prior to and after setting said packer assemblies;

said outer setting sleeve being connected to a first seal body at one end thereof which is slidably received on said mandrel exterior, said seal body having an outer recess for receiving one of said elastomeric seal rings; and a second seal body having an annular seal portion slidably received between said mandrel exterior and the end of said setting sleeve opposite said first seal body, said second seal body having an outer recess for receiving said other of said elastomeric seal rings, each of said recesses including a face region abutting an end of its associated seal ring and a sleeve portion which contacts the interior of its associated seal ring whereby sliding movement of said setting sleeves compresses said seal rings to set said packer assemblies.

4. A continuous flow perforation washing tool for use in a well bore comprising:

a tubular mandrel having exterior sidewalls and an interior flow passage, an upper end adapted to be connected in a pipe string extending to the well surface, and a lower end with a ball catching sub adapted to catch a ball dropped from the surface to thereby block the flow of fluids from said pipe string through said mandrel flow passage;

upper and lower packer assemblies carried on said mandrel at opposite ends thereof, each of said packer assemblies including a solid, compressible elastomeric seal ring;

an outer setting sleeve surrounding said mandrel between said packer assemblies defining an annular chamber between said mandrel and said setting sleeve, said annular chamber being in continuous fluid communication with said mandrel flow passage through port means provided in the sidewalls of said mandrel and with said well bore through orifice means provided in said setting sleeve, prior to and after setting said packer assemblies;

said outer setting sleeve being connected to a first seal body at one end thereof which is slidably received on said mandrel exterior, said seal body having an outer recess for receiving one of said elastomeric seal rings;

a second seal body having an annular seal portion slidably received between said mandrel exterior and the end of said setting sleeve opposite said first seal body, said second seal body having an outer recess for receiving said other of said elastomeric seal rings, each of said recesses including a face region abutting an end of its associated seal ring and a sleeve portion which contacts the interior of its associated seal ring whereby sliding movement of said setting sleeves compresses said seal rings to set said packer assemblies; and said orifice means being selectively sized to provide controlled flow to said well bore whereby fluid pressure communicated by said port means in said mandrel to said annular chamber acts on said first and second seal bodies to seal said elastomeric seal rings in said well bore.

5. A method for circulating fluid in a well having a perforated casing, comprising the steps of:

attaching a wash tool to the lower end of a pipe string, the wash tool having an inner mandrel with a flow passage therethrough communicating with said pipe string, pressure responsive, solid compressible packer assemblies at opposite ends thereof, a setting sleeve surrounding the mandrel between the packer assemblies to define an annular chamber between the mandrel and setting sleeve, port means communicating the mandrel interior with the annular chamber, and selectively sized orifices in said setting sleeve communicating the annular chamber with the well bore prior to and after setting said packer assemblies;

lowering the wash tool on the pipe string to the desired circulation level within said perforated casing;

actuating closure means to close the lower end of said mandrel flow passage;

pumping fluid through said pipe string to said closed mandrel flow passage, through said port means in said mandrel to said annular chamber, and continuously through said sized orifices in said setting sleeve to said well bore, the number and size of said orifices being selected to provide a controlled flow of fluid through said orifices to create a back pressure in said annular chamber and thereby hydraulically actuate said packer assemblies; and continuing to circulate fluid through said pipe string, mandrel, annular chamber and orifices, through perforations in said casing between said packer assemblies, through the zone surrounding said casing, through perforations in said casing above said packer assemblies and back to the surface of said well through the annulus between said pipe string and said casing.

6. The method of claim 5, wherein the diameters of said orifices provided in said setting sleeve are smaller than the diameters of said port means in said mandrel by a predetermined amount, the ratio of said diameters being selected to control the buildup of back pressure in said annular chamber.

7. The method of claim 5, wherein the number of orifices provided in said setting sleeve is greater than the number of port means in said inner mandrel by a predetermined amount, the number of orifices to port means being selected to control the buildup of back pressure in said annular chamber.

8. The method of claim 5, further comprising the step of lowering the pressure of fluid being pumped through said pipe string to unseat said packer assemblies, said fluid being continually flowed through said orifices in said setting sleeve and into said well bore.

* * * * *